US009816692B2

(12) United States Patent
Liao et al.

(10) Patent No.: US 9,816,692 B2
(45) Date of Patent: Nov. 14, 2017

(54) LUMINAIRE ELEMENT

(71) Applicant: PHILIPS LIGHTING HOLDING B.V., Eindhoven (NL)

(72) Inventors: Huaizhou Liao, Shanghai (CN); Yi Tang, Shanghai (CN); Feng He, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 476 days.

(21) Appl. No.: 14/379,511

(22) PCT Filed: Feb. 13, 2013

(86) PCT No.: PCT/IB2013/051160
§ 371 (c)(1),
(2) Date: Aug. 19, 2014

(87) PCT Pub. No.: WO2013/124766
PCT Pub. Date: Aug. 29, 2013

(65) Prior Publication Data

US 2015/0055343 A1 Feb. 26, 2015

(30) Foreign Application Priority Data

Feb. 21, 2012 (WO) ..... PCT/CN2012/071388

(51) Int. Cl.
*F21S 4/00* (2016.01)
*F21V 21/00* (2006.01)
(Continued)

(52) U.S. Cl.
CPC ..... *F21V 21/005* (2013.01); *F21K 9/20* (2016.08); *F21S 2/005* (2013.01); *F21V 23/06* (2013.01);
(Continued)

(58) Field of Classification Search
CPC ..... F21K 9/20; F21S 2/005; F21V 21/005; F21V 23/06; F21Y 2101/00;
(Continued)

(56) References Cited

U.S. PATENT DOCUMENTS 8,434,898 B2 * 5/2013 Sanfilippo ..... F21S 2/005 362/249.02
8,529,092 B2 * 9/2013 Lin ..... F21S 2/005 362/1
(Continued)

FOREIGN PATENT DOCUMENTS

DE 102007024362 A1 11/2008
EP 2221900 A2 8/2010
(Continued)

*Primary Examiner* — Tsion Tumebo

(57) ABSTRACT

A luminaire element (10) for a luminaire (1), which luminaire element (10) comprises a first light-emitting device (11); a second light-emitting device (12); a frame (2) realized to accommodate the first light-emitting device (11) and the second light-emitting device (12), which frame (2) comprises a connecting interface (22, 23) realized to physically and electrically connect to a further luminaire element (10) of the luminaire (1); and wherein the first light-emitting device (11) and the second light-emitting device (12) are arranged within the frame (2) such that the first light-emitting device (11) emits to a first side of the luminaire element (10), and the second light-emitting device (12) emits to a second side of the luminaire element (10).

10 Claims, 9 Drawing Sheets

(51) Int. Cl.

| | |
|---|---|
| ***F21V 21/005*** | (2006.01) |
| ***F21S 2/00*** | (2016.01) |
| ***F21V 23/06*** | (2006.01) |
| ***F21K 9/20*** | (2016.01) |
| *F21Y 105/00* | (2016.01) |
| *F21Y 103/10* | (2016.01) |
| *F21Y 115/10* | (2016.01) |
| *F21Y 115/15* | (2016.01) |
| *F21Y 107/00* | (2016.01) |

(52) U.S. Cl.
CPC ..... *F21Y 2103/10* (2016.08); *F21Y 2105/00* (2013.01); *F21Y 2107/00* (2016.08); *F21Y 2115/10* (2016.08); *F21Y 2115/15* (2016.08)

(58) Field of Classification Search
CPC ..... F21Y 2103/10; F21Y 2105/00; F21Y 2107/00; F21Y 2115/10; F21Y 2115/15
USPC ..... 362/249.03
See application file for complete search history.

(56) References Cited

U.S. PATENT DOCUMENTS

| | | | |
|---|---|---|---|
| 2004/0042199 | A1 | 3/2004 | Cok |
| 2004/0085762 | A1 | 5/2004 | Iwasa et al. |
| 2005/0248935 | A1 | 11/2005 | Strip et al. |
| 2008/0037284 | A1 | 2/2008 | Rudisill |
| 2010/0045175 | A1 | 2/2010 | Mathai et al. |
| 2010/0046210 | A1 | 2/2010 | Mathai et al. |
| 2011/0134639 | A1 | 6/2011 | Chung et al. |

FOREIGN PATENT DOCUMENTS

| | | | |
|---|---|---|---|
| EP | 2403317 | A1 | 1/2012 |
| WO | 2009072386 | A1 | 6/2009 |
| WO | 2010116301 | A1 | 10/2010 |
| WO | 2011058486 | A2 | 5/2011 |

* cited by examiner

FIG. 2 X - X'

LUMINAIRE ELEMENT

CROSS-REFERENCE TO PRIOR APPLICATIONS

This application is the U.S. National Phase application under 35 U.S.C. §371 of International Application No. PCT/IB13/051160, filed on Feb. 13, 2013, which claims the benefit of under 35 U.S.C. §371 of International Application No. PCT/CN2012/071388 filed on Feb. 21, 2012. These applications are hereby incorporated by reference herein.

FIELD OF THE INVENTION

The invention describes a luminaire element for a luminaire; a luminaire element frame; and a luminaire.

BACKGROUND OF THE INVENTION

The manufacture of semiconductor-based light-emitting devices such as organic light-emitting diodes (OLEDs) has been commercialized, and such light-emitting devices can be readily manufactured using techniques of mass production. OLEDs are widely used in displays, for example, in mobile phone displays, camera displays, television displays, etc. However, the use of OLEDs in lighting applications such as home or commercial lighting is not widespread owing to various barriers in realisation. For example, even though the use of OLEDs might now be affordable option, it has proven difficult to incorporate them in lighting applications. The actual deploying of an OLED in a luminaire is not a straightforward matter. This is partially owing to the essentially planar shape of an OLED, which necessitates a flat or planar luminaire, which may not be regarded as practical or attractive.

Also, the conductive properties of the materials used in an OLED are generally relatively poor, and techniques for improving the conductivity—and therefore also the light homogeneity across the active layer—are often associated with an increase in device thickness or a decrease in the transparency of a layer through which the light should be emitted. Furthermore, a "large" OLED typically requires more than two electrode contact regions. For example, an OLED might have several anode contact regions and several cathode contact regions, in order to improve the voltage distribution across the active layer. In the known approaches, all contact regions for an electrode are electrically connected together using external circuitry with the aim of improving the electrode conduction characteristics. This requires additional expensive circuitry and additional manufacturing steps.

Any OLED incorporated in a luminaire must be enclosed to protect the fragile substrate and to ensure that the active layer and the electrodes are protected from moisture and the effects of corrosion. Such a dedicated frame or cover for a luminaire adds to the overall cost. Furthermore, it may be desired to have a luminaire that emits light on both sides. However, an OLED that emits on both sides, for example a transparent OLED or TOLED, requires more investment at manufacturing level, for example a dedicated production line, so that a luminaire using such OLEDs would be prohibitively expensive.

Therefore, it is an object of the invention to provide a more straightforward and economical luminaire using semiconductor light-emitting devices.

SUMMARY OF THE INVENTION

The object of the invention is achieved by a luminaire element for a luminaire, comprising a first light-emitting device; a second light-emitting device; and a frame realised to accommodate the first light-emitting device and the second light-emitting device, which frame comprises a connecting interface realised to physically and electrically connect to a further luminaire element of the luminaire; and wherein the first light-emitting device and the second light-emitting device are arranged within the frame such that the first light-emitting device emits to a first side of the luminaire element, and the second light-emitting device emits to a second side of the luminaire element. For example, the first light-emitting device may emit light outward from the luminaire element in a first direction, while the second light-emitting device emits outward in a second direction that is essentially opposite to the first direction. In other words, light is emitted outward from both sides of the luminaire element.

An advantage of the luminaire element according to the invention is that light-emitting devices can simply be placed in a frame, or "housing frame", such that one light-emitting device emits to one side while the other light-emitting device emits to the other side. In this way, a double-sided luminaire—i.e. a luminaire that emits on two sides—can easily be obtained as an economical alternative to expensive top-and-bottom-emitting devices. Furthermore, the luminaire element according to the invention does not require additional external circuitry to connect the electrodes of light-emitting devices of neighbouring luminaire elements, since these connections are realised integrally in the frame, i.e. as part of the frame itself.

The object of the invention is also achieved by a luminaire element frame, which frame is realised to accommodate a first light-emitting device and a second light-emitting device, and which frame comprises at least one connecting interface realised to physically and electrically connect to a further luminaire element of the luminaire.

An advantage of the frame according to the invention is that it does away with the need to provide expensive additional external circuitry for electrically connecting the electrodes of the light-emitting devices. Furthermore, the frame according to the invention allows a particularly simple and straightforward connection of multiple luminaire elements, so that a practical and versatile luminaire can be obtained at favourably low cost.

The object of the invention is also achieved by a luminaire comprising a plurality of such luminaire elements, wherein each luminaire element comprises such a frame, and wherein the luminaire elements are physically connected by the connecting interfaces of the frames, and wherein electrode contacts of the light-emitting devices contained in the frames are electrically connected by electrode contact extending regions of the frames.

An advantage of the luminaire according to the invention is that any number of luminaire elements can be connected together in a modular manner in a luminaire framework, such that the light-emitting devices of each luminaire element emit light, even though the poles of a voltage source need only be connected across electrode contact extending regions of one or two of a plurality of luminaire elements.

The object of the invention is also achieved by an assembly element comprising a number of connecting interfaces, wherein a connecting interface of the assembly element is realised for connection to a connecting interface of a frame of such a luminaire element.

The object of the invention is also achieved by a luminaire kit comprising a plurality of such luminaire elements, wherein each luminaire element comprises such a frame, and wherein the luminaire elements are physically and electrically connectable by connecting interfaces of the frames, and wherein electrode contacts of the light-emitting devices contained in the frames are electrically connected by electrode contact extending regions of the frames; and wherein the luminaire kit optionally comprises a number of such assembly elements for connecting luminaire elements.

An advantage of the luminaire kit according to the invention is that it can provide a very easy way for a consumer to construct a unique luminaire, since a wide variety of forms is possible, particularly when the luminaire elements are assembled using such assembly elements.

The dependent claims and the following description disclose particularly advantageous embodiments and features of the invention. Features of the embodiments may be combined as appropriate. Features described in the context of one claim category can apply equally to another claim category.

The luminaire element according to the invention can be realised using any suitable light-emitting devices. Preferably, however, the luminaire element according to the invention comprises organic light-emitting devices (OLEDs). An OLED is generally planar in form, and such a planar device can be favourably held in a frame. In the following therefore, without restricting the invention in any way, it may be assumed that the light-emitting devices of the luminaire element are OLEDs. Also, the terms "frame" and "housing frame" may be used interchangeably.

Preferably, a light-emitting device comprises an encapsulated OLED such as a standard OLED. Such a device generally comprises a substrate, upon which are layered an anode, an active or emissive layer, and a cathode, and the layers are hermetically sealed within a cover. Standard OLED devices are readily available and can be relatively economically manufactured in large numbers using established manufacturing techniques and equipment.

The first and second OLEDs can be arranged in the housing frame in any suitable way. For example, two OLEDs can be stacked and held or supported in this stacked arrangement by the housing frame. However, a standard OLED generally only emits light through a transparent substrate upon which a transparent anode is applied, while an opaque cathode is applied between the active layer and the encapsulating cover. Therefore, such an OLED does not emit light through the cover. In a preferred embodiment of the invention, therefore, the first and second OLEDs are arranged in a back-to-back arrangement, for example so that the cover of the first OLED is arranged vis-à-vis the cover of the second OLED. Of course, if the device layer structure were such that the OLEDs emit through a transparent cover, the first and second OLEDs could be arranged such that their substrates are back-to-back. Basically, any type of OLED can be used—bottom-emitting OLED, top-emitting OLED, transparent OLED, inverted OLED, etc., depending on the optical effect that is desired, and whether such OLEDs are available as standard OLEDs. However, in the following, it may be assumed that a bottom-emitting OLED is used, for which a transparent anode is applied to a transparent substrate such as clear glass or clear plastic; that the active layer is applied on top of the anode layer; and that the cathode is applied on top of the active layer. The anode can comprise indium tin oxide (ITO), while the cathode can comprise aluminium, or a suitable metal such as barium covered with a capping layer of aluminium. Using such an arrangement of two OLEDs, the luminaire element can be favourably slim, since the thickness of the luminaire element does not have to exceed the combined device thicknesses by any significant amount.

To allow connection to a voltage supply, the contact regions for the anode and cathode of an encapsulated OLED generally extend beyond the cover. In a particularly preferred embodiment of the invention, a light-emitting device comprises at least one anode contact region and at least one cathode contact region, wherein a contact region is arranged along an edge of the light-emitting device. For example, such an exposed contact region can extend or run along the entire edge of one side of the OLED. Preferably, for improved voltage distribution over the active layer and therefore favourably uniform light emission characteristics, the OLED comprises two anode contact regions and two cathode contact regions, whereby contact regions of the same polarity are preferably arranged on opposite sides of the OLED.

A luminaire element can comprise any shape. For example, a luminaire element could exhibit a circular or disc-shaped form. A luminaire element is also not necessarily planar or flat, and could exhibit a curved form. Preferably, the luminaire element follows the shape of the OLEDs that are implemented. For example, if the OLEDs comprise an essentially polygonal form, the housing frame and therefore the luminaire element also comprises the same polygonal form. Standard OLEDs comprise a rectangular, almost square, or essentially square shape, so that, when standard OLEDs are used in the luminaire element according to the invention, the housing frame and therefore also the luminaire element will comprise essentially the same rectangular or square shape. For an OLED with a rectangular shape (even if this is almost square-shaped), an arrangement of anode contact regions along two opposite edges of the OLED, and a corresponding arrangement of cathode contact regions along the other two opposite edges of the OLED, allows error-free assembly of the OLEDs in the housing frame, since the OLED will always be mounted in a correct electrical orientation in the housing frame.

The anode layer applied to the substrate is generally very thin, for example a thin layer of ITO sputtered onto a glass substrate. If an electrical contact is made directly to this thin anode layer, it can be damaged relatively easily. For this and other reasons, in a preferred embodiment of the invention, a molybdenum-aluminium-molybdenum (MAM) layer is applied onto the anode contact region. This MAM layer can be considerably thicker than the anode layer, and serves to decrease the electrical resistance of the anode contact region. The MAM layer is opaque, but does not detract from the optical properties of the OLED since it is only applied in areas in which no light is emitted anyway. An electrical connection can be made between a surface region of this MAM layer and a surface region of a contact leading to an external voltage source, as will become clear in the following. Effectively, the MAM layer "merges" with the electrode contact region to which it is applied, so that the outer surface of the MAM layer can also be regarded as the electrode contact region.

As indicated above, it is preferred to apply the same voltage to each electrode of a certain polarity, so that a favourably uniform voltage distribution can be obtained across the OLED. However, when the electrode contact regions for one polarity are arranged on different sides of the OLED, for example on opposite sides, it can be a more complicated matter to ensure that the separate regions are connected to the same voltage, while keeping the device size favourably small. Thin wires could be used to connect different electrode contact regions of the same polarity, and these could be covered with an insulation, or laid in such a way that they do not touch each other or a contact region of the other polarity. However, such measures usually involve increasing the device size or thickness. In a particularly preferred embodiment of the invention, the luminaire element comprises a layer element with an electrically conductive anode joining region for electrically connecting spatially separate anode contact regions of a light-emitting device, and/or an electrically conductive cathode joining region for electrically connecting spatially separate cathode contact regions of the light-emitting device. For example, the layer element can be realised as a printed circuit board (PCB) with a shape corresponding to that of the housing frame and the OLEDs. The PCB can be made of a thin layer of plastic, with a cathode joining region and an anode joining region printed onto the plastic. For example, for a rectangular OLED with oppositely placed anode contact regions and cathode contact regions, the PCB can comprise a cathode joining region formed by a printed conductive layer comprising two regions that correspond in shape to the areas of the two cathodes, connected by a narrow conductive strip, and an anode joining region formed by a printed conductive layer comprising two regions that correspond in shape to the areas of the two anodes, also connected by a narrow conductive strip. The narrow conductive strip connecting two regions of the same polarity can be spatially separated on the PCB from a region of the other polarity, so that these are electrically isolated from each other. In other words, the cathode joining region is electrically isolated from the anode joining region. Use of such a PCB layer element to optimally apply the same voltage to all electrodes of the same polarity can extend the lifetime of the OLED while at the same time ensuring that the light emission in the active layer is more homogenous. Such a layer preferably comprises through-connectors for electrically contacting the conductive surfaces of an electrode contact region of the OLED and a conductive electrode contact extending region of the frame. Such through-connectors effectively ensure that the electric potential on either side of the layer is the same at that point.

The layer element could be made to be essentially the same size as an OLED, and to fit between the first and second OLED in a sandwich manner. However, this would add to the overall thickness of the device, and the area of PCB that extends over the central emitting area would effectively be wasted, since the electrode contact regions only extend along the edges of the OLED. Preferably, therefore, the layer element is realised to be accommodated between an OLED and a body portion of the housing frame, such that the layer element does not add to the overall height of the luminaire element. The layer element can be realised, for example, in the shape of a "picture frame" with an aperture to accommodate the encapsulating covers of the OLEDs. Also, the combined thicknesses of a MAM layer and a PCB layer element can be chosen, for example, not to exceed the height of the encapsulating cover. Of course, if no MAM layer is used, and if the PCB layer element is in direct contact to the electrode contact regions, the thickness of the PCB layer element can correspond effectively to the height of the encapsulating cover.

A robust and uniform electrical contact is preferred over the entire surface of any region acting as an electrode, in order to obtain an optimal homogenous current distribution through the layers of the OLED. In one approach, for example, a layer element can be glued to the electrode contact regions using a conductive glue to bond them. Here, it must be ensured that the glue does not extend between regions of opposite polarity. Alternatively, the components can be bonded or soldered together using an appropriate soldering technique. Here also, since solder is electrically conducting, care must be taken that the molten solder does not make an electrical connection between regions that should remain isolated from each other. Therefore, in a particularly preferred embodiment of the invention, the conductive regions—usually metal—are bonded to an appropriate region of the housing frame. For example, an anisotropic conductive film (ACF) bonding technique could be applied. Such a technique results in a robust physical connection with favourable conductive properties.

The housing frame preferably also permits an electrical connection between adjacent luminaire elements joined by connecting interfaces. Therefore, in a particularly preferred embodiment of the invention, a housing frame comprises an electrode contact extending region for extending an electrode contact of a light-emitting device arranged or contained within the housing frame to an exposed outside surface of the connecting interface. For example, on an inner wall of the housing frame, a thin layer of a conductive material such as metal can be applied to coincide with regions of the MAM layer or PCB layer, and can extend to an outer surface of the housing frame, so that this electrode contact extending region can electrically connect to a corresponding electrode contact extending region of an adjacent connected housing frame.

The housing frame can simply comprise a "wall" shaped to fit about the OLEDs it contains, with one or more connecting interfaces arranged along the exterior of the wall. The OLEDs, with MAM and/or PCB layer if these are being used, can be bonded in some way to the inner wall surfaces. However, such a realisation might be easily damaged, since a pressure applied to the OLEDs might push these through the housing frame wall. Therefore, in a preferred embodiment of the invention, the housing frame comprises a flange portion realised to extend into a cavity or space between an electrode contact of the first light-emitting device and an electrode contact of the second light-emitting device when these are arranged back-to-back. The flange can extend all the way about the interior of the housing frame. Preferably, the flange is shaped to extend from an outer edge of the substrate of an OLED to the outer side of the encapsulating cover. For example, the combined thickness of the flange, and the MAM layer and/or PCB layer can be chosen to not exceed the height of the encapsulating cover. In this way, a favourably thin device thickness can be obtained.

The electrode contact extending region can have any suitable dimensions and can cover any suitable area of the housing frame connecting interface surface. For example, the electrode contact extending region could be as wide as the side of the OLED device. Preferably however, the electrode contact extending region extends only partially over the frame body portion of the connecting interface, for example as a strip or band. The thickness and width of the band can be chosen to satisfy a minimum conductive requirement of the electrode contact extending region, since the conductivity of the electrode contact extending region should be favourably high, but will be governed by the thickness and width of the band. Since the interconnecting parts of the frames may fit quite tightly, it may be preferably to have a very thin band, particularly if this is applied to the surface of the frame, so that the width can be chosen accordingly. Of course, the electrode contact extending region could be set into the body of the housing frame in an appropriately shaped recess or groove, in which case a narrower and thicker realisation may be possible.

The electrode contact extending region of a housing frame can serve to connect an electrode of one OLED with an electrode of an another OLED, depending on the realisation of the electrode contact extending region on the housing frame, and depending on the way in which luminaire elements are connected in the assembled luminaire. For example, an electrode contact extending region can be applied to the housing frame so that it contacts an electrode of only one OLED in a first luminaire element, for example the anode of the first OLED. Depending on how a second luminaire element is connected to the first luminaire element, that electrode contact extending region might be electrically connected to an anode or to a cathode of an OLED in the second luminaire element. If the electrode contact extending region contacts an anode of the OLED in the second luminaire element, the OLEDs can effectively be connected in parallel in the overall circuit. On the other hand, if the electrode contact extending region contacts a cathode of the OLED in the second luminaire element, the two OLEDs can effectively be connected in series in the overall circuit.

Since the luminaire element according to the invention preferably comprises a first OLED and a second OLED in a back-to-back arrangement, and the OLEDs preferably have the same spatial arrangement of electrode contacts, it follows that an electrode contact extending region for an electrode contact of the first OLED can be arranged on one surface of the housing frame flange, while an electrode contact extending region for an electrode contact of the second OLED can be arranged on the other side of the housing frame flange, for example one "on top" and one "underneath", when the housing frame is viewed from the side. Of course, the same applies to the remaining electrode contacts of the OLEDs. If the electrode contact extending regions for spatially superposed electrode contacts of the two OLEDs are electrically isolated from each other, then if follows that these do not have to be assigned to electrode contacts of the same polarity. One electrode contact extending region can contact the anode of one OLED, while the other electrode contact extending region can contact the cathode of the other OLED. Such an arrangement might require that the OLEDs are essentially symmetrical in shape about more than one axis of symmetry—for example the OLEDs might have a square shape or a circular shape.

In another realisation, an electrode contact extending region can be applied to the housing frame so that it "wraps around" a flange of the housing frame, so that it contacts the same electrodes of the first and second OLEDs in that luminaire element, for example the spatially superposed anodes of both OLEDs. If the superposed cathodes are connected in the same manner by the same type of electrode contact extending region at another housing frame edge, the first and second OLEDs of that luminaire element are effectively always connected in parallel. Again, depending on how a second such luminaire element is connected to a first such luminaire element, the parallel-connected OLED pair of the first luminaire element can be connected in series or in parallel to a parallel OLED pair of the second luminaire element.

A connecting interface can be achieved in a number of ways, for example a threaded connection or a snap-fit connection, etc. However, a realisation that allows a straightforward modular assembly of the luminaire may be preferred, particularly a realisation not requiring any tools or special knowledge, so that essentially any customer can succeed in assembling a luminaire. Therefore, in a particularly preferred embodiment of the invention, the connecting interface comprises a tongue realised to connect to a groove of a further connecting interface of the luminaire and/or a groove realised to connect to a tongue of a further connecting interface of the luminaire. This realisation allows, for example, the tongue of one housing frame to simply be inserted into the groove of another housing frame, thereby connecting two luminaire elements in a simple and straightforward manner.

The connecting interface can be realised along a portion of a housing frame edge, for example along a central portion. However, for favourable stability of the assembled luminaire, a connecting interface preferably extends along a lateral edge of the housing frame, preferably over essentially the entire length of the housing frame edge. For example, a tongue/groove can extend along the entire length of a housing frame lateral edge. The tongue/groove elements are preferably formed to be close-fitting. Even so, the electrode contact extending regions need only occupy a fraction of the length of a connecting interface, for example a central portion. When several luminaire elements are connected using such connecting interfaces, a particularly robust and stable construction or framework is obtained. Such a luminaire can retain its shape even under the influence of gravity, for example. Any forces acting on a connecting interface are favourably distributed along the entire length of the connecting interface, so that such a joint or connection is more robust than, for example, a point-like connecting interface or a connecting interface limited to only a short portion of the frame lateral edge.

Using housing frames with tongue-and-groove connectors along their lateral sides, an essentially planar luminaire can be achieved by simply sliding the tongue of one housing frame into a groove of another housing frame, and repeating this until a planar luminaire of the desired area has been obtained. However, it may be desired to assemble a more "three-dimensional" luminaire. Therefore, in a preferred embodiment of the invention, the luminaire comprises an assembly element with a plurality of connecting interfaces, which assembly element is realised for connection between two adjacent light-emitting luminaire elements. The assembly element can be made of the same material as the housing frame, for example a suitable plastic material, and can be as long as a lateral edge of a housing frame. Depending on the nature of the three-dimensional shape desired, an assembly element can be triangular or square in cross-section, or can have any appropriate polygonal cross-section. Of course, if curved frames are used for curved OLEDs, the assembly elements can also have an essentially curved shape. An assembly element could of course have a circular cross-section, if desired.

Preferably, the assembly elements should contribute to the electrical interconnection of adjacent luminaire elements. Therefore, in a preferred embodiment of the invention, an assembly element also comprises electrode conductive regions to electrically connect electrode contact extending regions of the housing frames of adjacent light-emitting luminaire elements. These can be formed in the same way as the electrode contact extending regions of the housing frames, for example using a thin band of conductive material arranged to coincide with the placement of the electrode contact extending regions of the housing frames. In this way, for example, the anodes of the first OLEDs of two adjacent luminaire elements can be electrically connected, while the anodes of the second OLEDs of those luminaire elements are also electrically connected. Also, such an assembly element can allow a luminaire construction comprising intersecting "planes" of luminaire elements, since electrically separate electrode conductive regions on an assembly element can be arranged to wrap about each other in a three-dimensional manner while remaining electrically isolated from each other. This will become clear in the diagrams below.

The luminaire according to the invention can be supplied in the form of a kit, with a plurality of luminaire elements and a means of connecting the assembled luminaire to a voltage source. The assembly may be self-explanatory, for example clearly visible relief symbols for "+" and "–" formed on outside surfaces of the luminaire elements can indicate how the luminaire elements can be interconnected. Such a kit may or may not also include a number of additional assembly elements so that the consumer can assemble a "three-dimensional" luminaire. Such a kit might also include frame cover elements for covering the unused outer housing frame portions in order to protect any exposed electrode contact extending regions from damage or corrosion, while also obtaining a pleasing optical finish. The means for connecting the assembled luminaire to a voltage source can comprise a DC voltage source such as a battery, or a transformer with plug for connecting the luminaire to an AC voltage supply, for example for connecting to a 230 V or 110 V consumer grid. Poles of the voltage source can be connected using suitable pole connectors, one each for an anode and a cathode of a luminaire element of the luminaire. For example, a pole connector can be formed using a frame cover element. A wire or cable from the voltage source can be embedded in the frame cover element and arranged to electrically connect to an electrode contact extending region of a housing frame of a luminaire element when the frame cover element is attached to that housing frame.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
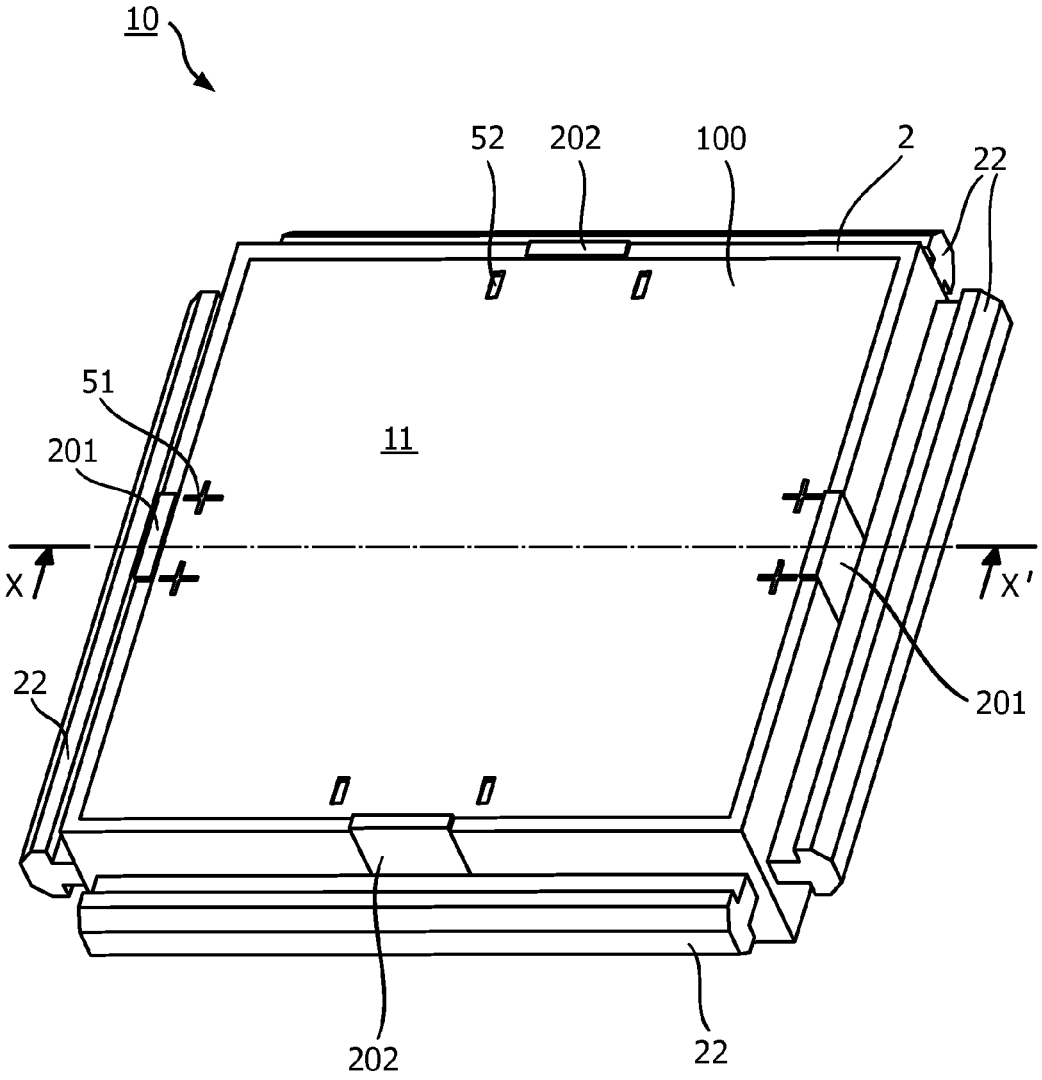
FIG. 1 shows a luminaire element according to a first embodiment of the invention.

FIG. 1 shows a luminaire element 10 according to a first embodiment of the invention. Here, a rectangular or square-shaped housing frame 2 is realised with connecting means 22 on its four sides. The diagram shows a tongue connector 22 on each of the four sides of the housing frame 2. The diagram shows that an electrode contact extending region 201, 202 terminates at the point where the tongue 22 protrudes from the housing frame 2. In this embodiment, the polarity of each electrode contact extending region 201, 202 is clearly indicated by the visual indicators or symbols 51, 52 on the luminaire element 10. The diagram shows a first standard OLED 11 fitting closely in the housing frame 2, so that the housing frame 2 itself makes only a small contribution to the overall area. The planar surface comprises a substrate 100 of the first OLED 11. Underneath the luminaire element 10, so that it cannot be seen in the diagram, is a second standard OLED 12.

Figure 2:
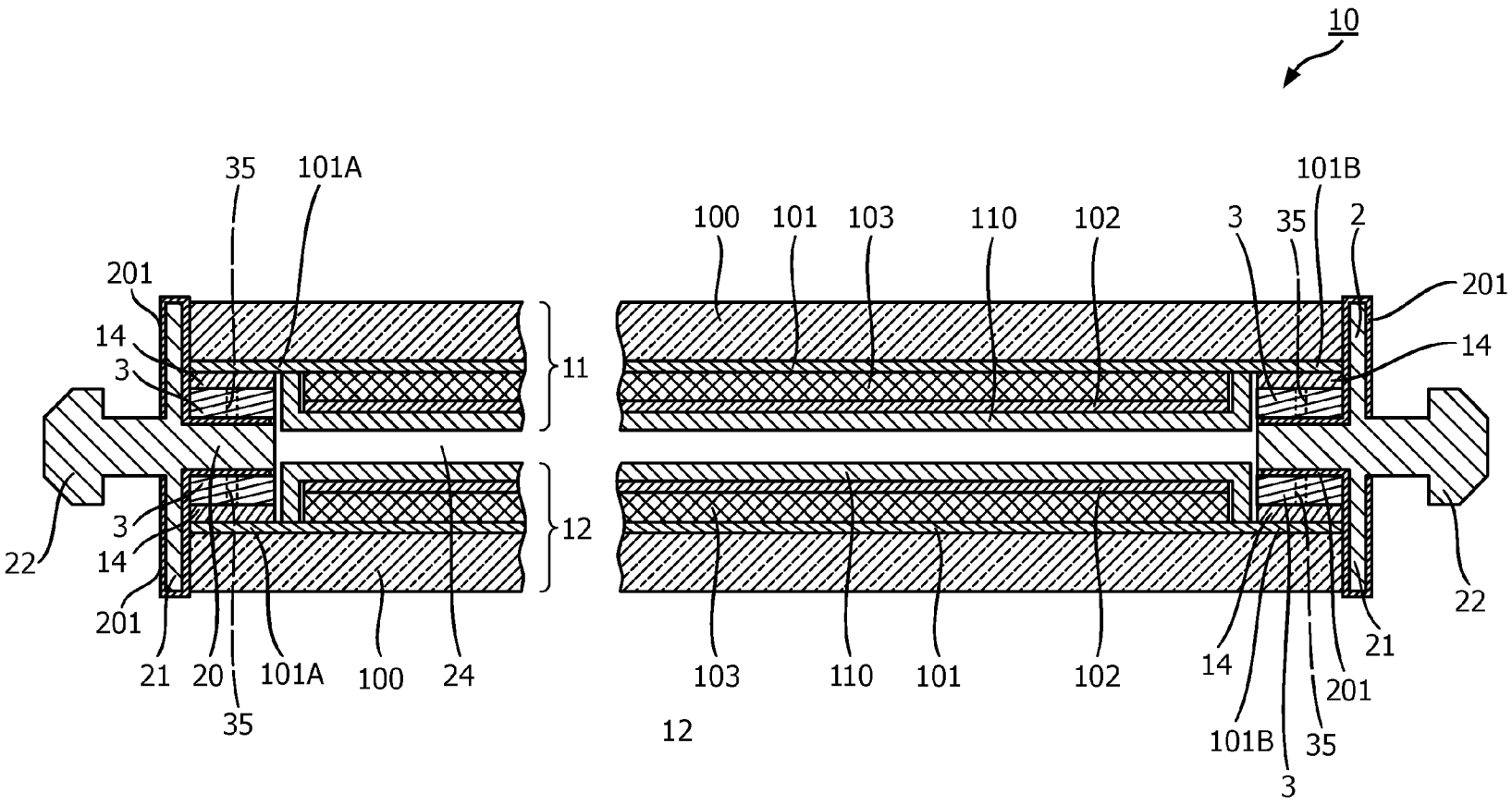
FIG. 2 shows a cross-section through the luminaire element of FIG. 1.

FIG. 2 shows a cross-section X-X' through the luminaire element 10 of FIG. 1. Here, the layer structure of the standard OLEDs 11, 12 is clearly shown. Each OLED 11, 12 comprises a substrate 100, onto which are applied in succession an ITO anode 101; an active layer 103; and a cathode 102. Each OLED 11, 12 is encapsulated in a hermetic cover 110. The diagram shows the back-to-back placement of the OLEDs 11, 12 in the housing frame 2. The housing frame 2 comprises a flange 20 that extends someway into the frame interior, but not beyond the side wall of the cover 110. The flange 20 leaves an aperture 24 for accommodating the encapsulating covers 110 of the OLEDs 11, 12. This cross-section X-X' shows anode contact regions 101A, 101B for the OLEDs 11, 12. A cross-section taken at right angles to this would show a similar arrangement of cathode contact regions for the OLEDs 11, 12. In each case, a MAM layer 14 is applied to the electrode contact regions of both OLEDs 11, 12 to improve the electrical conductivity of the electrodes 101, 102 and to provide an improved contacting surface. To electrically connect the anode contact regions 101A, 101B on opposite sides of the devices 11, 12, a PCB layer 3 is placed between the frame flange 20 and the MAM layer 14 of each device 11, 12. The PCB layer 3 comprises through-connectors 35 for electrically contacting the conductive surfaces of the MAM layer and a metal electrode contact extending region 201 of the frame 2. The PCB layer 3 can also serve as bonding means, since they can be bonded relatively easily to both the MAM layer 14 and a metal electrode contact extending region 201 of the frame using an ACF bonding technique described above. The ACF bonding can be applied to make a bond essentially all the way around the OLED device 11, 12 where the MAM layer meets the PCB layer. For a housing frame with four sides and four connecting means as shown here, a "picture frame" PCB layer 3 can be used to make four ACF bonds, one at each side of the housing frame 2, where the PCB layer 3 meets the electrode contact extending regions of the housing frame 2. Again, this diagram can only show the two anode contact extending regions 201 of the frame 2, while the two cathode contact extending regions would be seen in a cross-section taken at right angles to this.

The thickness of the MAM layer 14, the PCB layer 3, and the flange 20 are chosen such that the combined thickness of the MAM layer 14, the PCB layer 3, and half the flange thickness does not exceed the height of a cover 110. In this way, the OLED devices 11, 12 can be arranged in a back-to-back manner with little or no gap between them, resulting in a favourably slim or thin luminaire element 10. At present, a typical thickness or "height" of an OLED device 11, 12 is approximately 1.8-2.0 mm. The entire luminaire element 10 of the invention is therefore favourably thin, with a thickness or height of only about 3.8-4.2 mm. The width and length of the emitting area of such an OLED device 11, 12 at present can be about 50-140 mm, and it is expected that advances in technology will lead to even larger surface areas, so that such a luminaire element 10 can be used to construct luminaries for practical and interesting lighting applications.

This diagram shows the electrode contact extending regions 201 terminating at the edge of the frame flange 20, so that the anodes 111 of the first and second OLEDs 11, 12 are electrically separate from each other. Of course, the electrode contact extending regions 201 could wrap around the edge of the frame flange 20 (this possibility is indicated in the description), so that the anodes 101 of the first and second OLEDs 11, 12 are electrically connected. If the cathode contact extending regions also wrap around the edge of the frame flange 20, the first and second OLEDs 11, 12 of this luminaire element 10 will always be connected in parallel.

Figure 3:
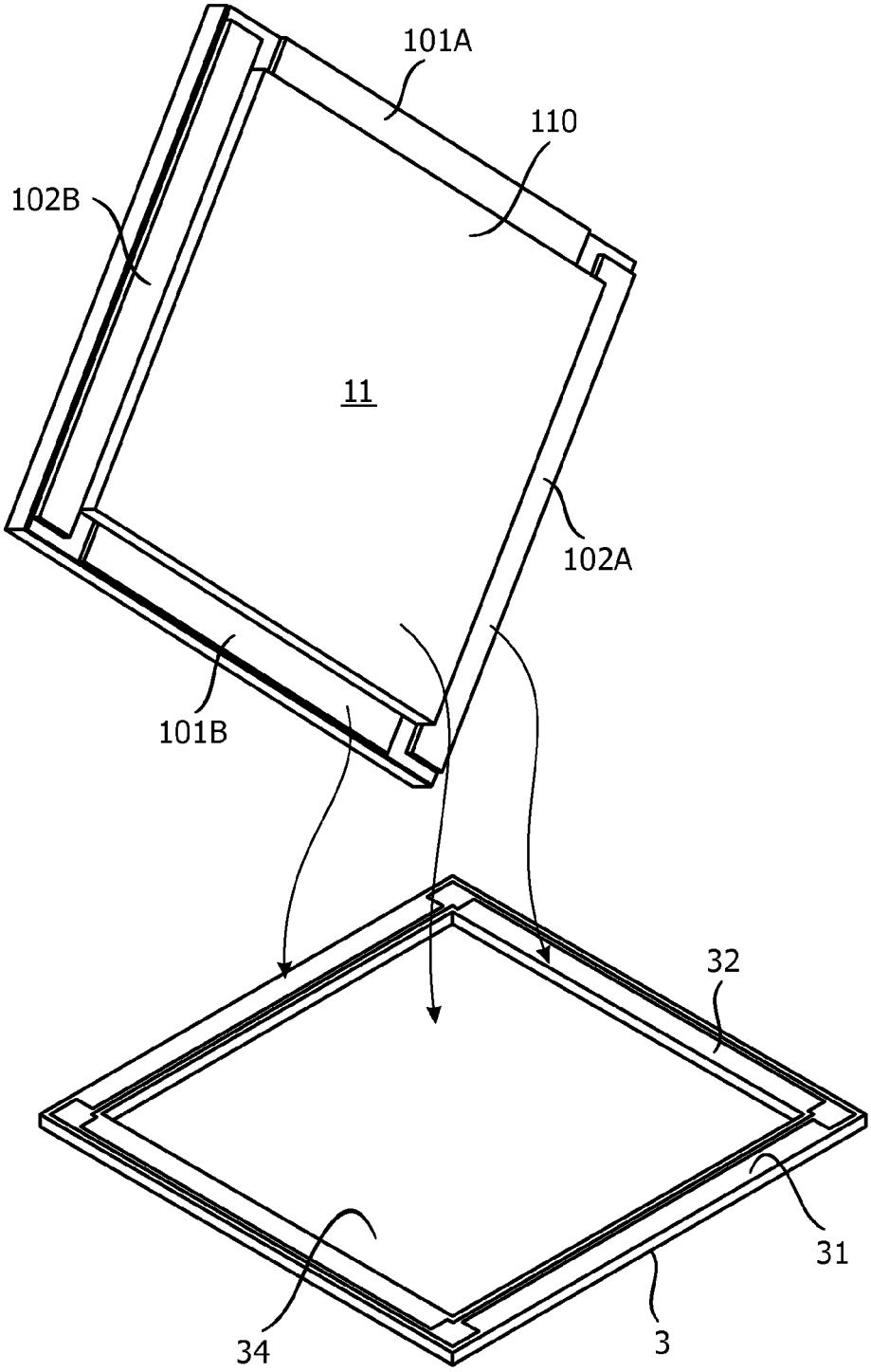
FIG. 3 shows a light emitting device and a layer element of the luminaire element of FIG. 1.

FIG. 3 shows a light emitting device 11 and a layer element 3 of the luminaire element 10 of FIG. 1, and indicates how these would be connected together. The OLED 11 has anode contacts 101A, 101B and cathode contacts 102A, 102B, given by the outer surface of the MAM layer. For optimal voltage distribution across the electrodes 101, 102 of the OLED, the same potential should be applied to each electrode 101, 102. This is achieved with the PCB layer 3, comprising a "picture frame" realisation with an aperture 34 to accommodate the encapsulating cover 110 of the OLED 11. The PCB layer 3 has an anode region 31 shaped to cover almost the entire surface of the anode contacts 101A, 101B, and a cathode region 32 shaped to cover almost the entire surface of the cathode contact 102A, 102B. These regions 31, 32 are electrically isolated from each other by the material of the PCB onto which the contact regions 31, 32 are printed. When assembled, any voltage applied across these regions 31, 32 will be applied also across the electrodes 101, 102 of the OLED 11 without any significant drop in potential between electrode contacts arranged on opposite sides of the device 11.

Figure 4:
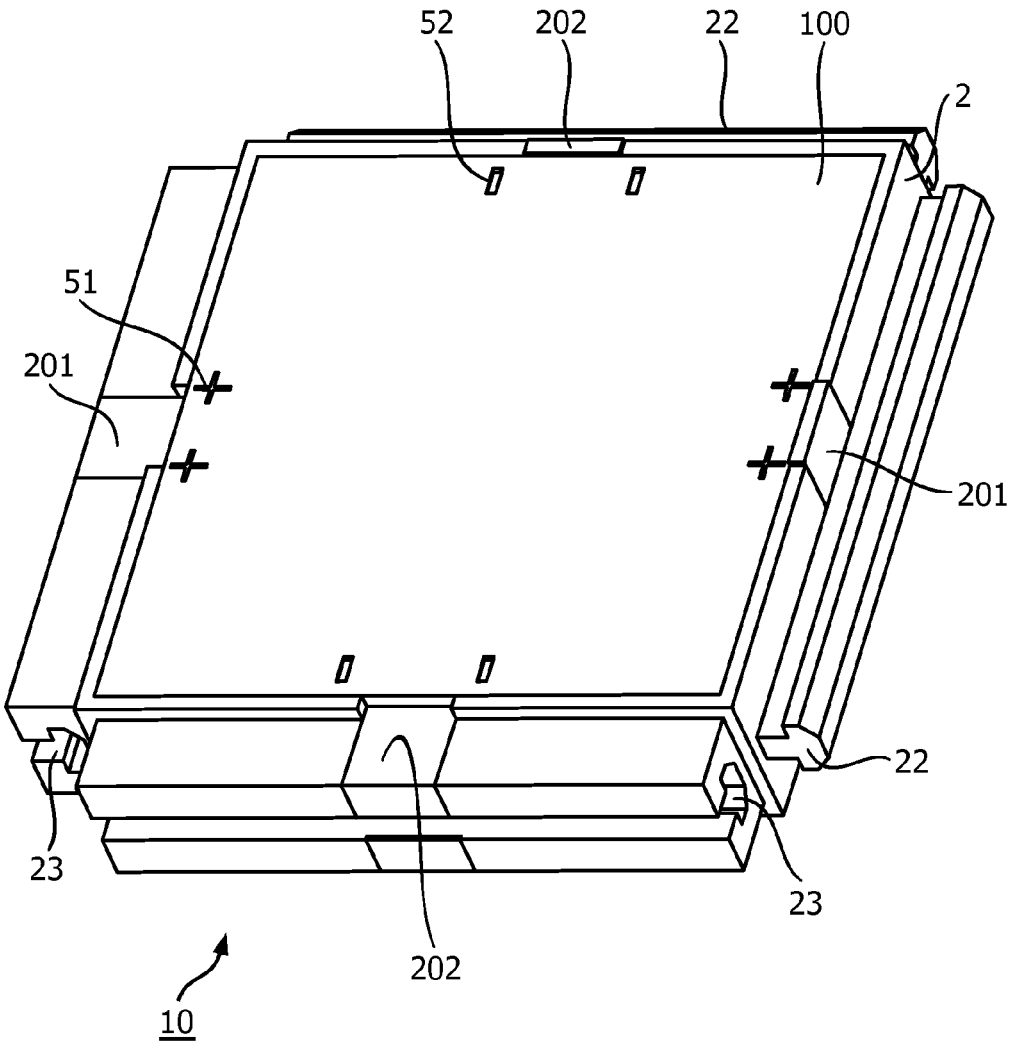
FIG. 4 shows a luminaire element according to a second embodiment of the invention.

FIG. 4 shows a luminaire element 10 according to a second embodiment of the invention. Here, the housing frame 2 is realised to have different connecting means 22, 23 on its four sides. The diagram shows a tongue connector 22 on the right and at the top of the housing frame 2, and a groove connector 23 on each of the left and bottom sides of the housing frame 2. The diagram shows that an electrode contact extending region 201 terminates at the point where the tongue 22 protrudes from the housing frame 2, while an electrode contact extending region "wraps around" the wall parts of a groove 23. Here also, the polarity of each electrode contact extending region 201, 202 is clearly indicated by the symbols 51, 52 on the luminaire element 10.

Figure 5A:
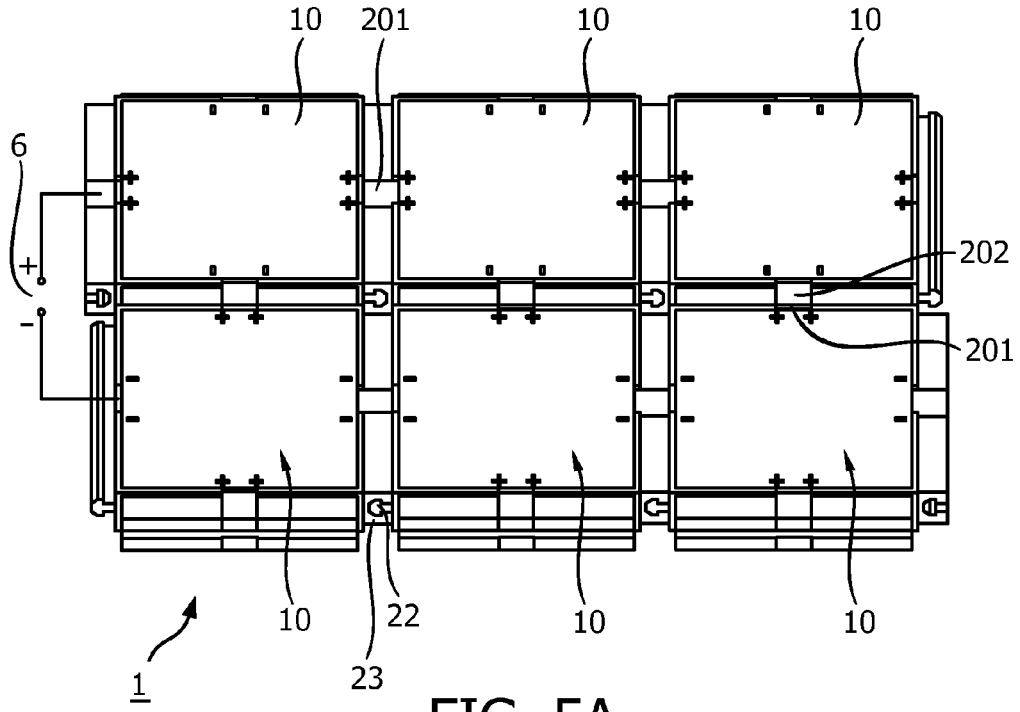
FIG. 5A shows a luminaire according to a first embodiment of the invention.

FIG. 5A shows a luminaire 1 according to a first embodiment of the invention. Here, six luminaire elements 10 are connected together by the connecting means 22, 23 of the housing frames 2. For the purposes of explanation, it may be assumed that the diagram shows the first OLEDs 11 of each luminaire element 10, while the second OLEDs 12 are underneath these and therefore cannot be seen in the diagram. Here, a positive pole of a DC voltage source 6 is connected to an anode of the first OLED of the luminaire element 10 in the upper left of the drawing, and a negative pole of the DC voltage source 6 is connected to a cathode of the first OLED of the luminaire element 10 in the lower left of the drawing.

The first OLED 11 of the luminaire element 10 in the upper left of the drawing is connected in series with the first OLED 11 of the luminaire element 10 in the lower left of the drawing, by means of the electrode contact extending regions 201, 202 of the (horizontal) connecting means between the upper and lower luminaire elements 10.

Similarly, the first OLED 11 of the luminaire element 10 in the upper centre of the drawing is connected in series with the first OLED 11 of the luminaire element 10 in the lower centre of the drawing.

In the same way, the first OLED 11 of the luminaire element 10 in the upper right of the drawing is connected in series with the first OLED 11 of the luminaire element 10 in the lower right of the drawing.

The series-connected OLEDs 11 are all connected in parallel by the electrode contact extending regions 201, 202 of the (vertical) connecting means 22, 23 between the left and centre luminaire elements 10, between the centre and right luminaire elements 10.

Figure 5B:
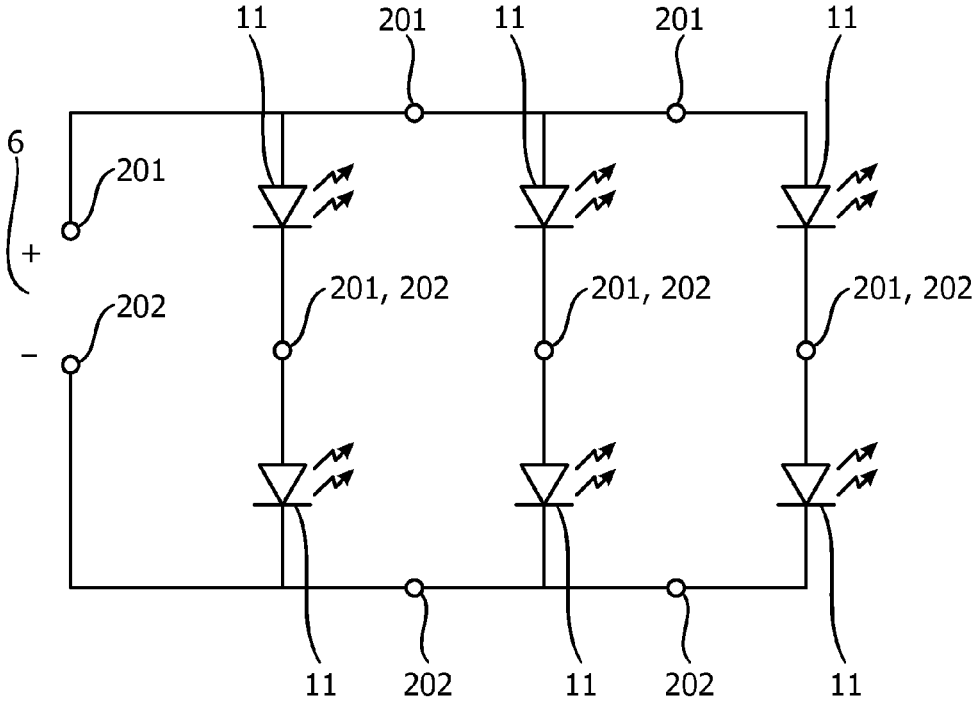
FIG. 5B shows an equivalent circuit of the luminaire of FIG. 5A.

An equivalent circuit for this luminaire realisation is shown in FIG. 5B, where each light-emitting diode symbol corresponds to a first OLED 11 in a luminaire element 10 of the luminaire 1. The node symbols indicate the electrical connections between pairs of anode contact extending regions 201; pairs of cathode contact extending regions 202; or a connection between an anode contact extending region 201 and a cathode contact extending region 202, as appropriate.

Figure 6A:
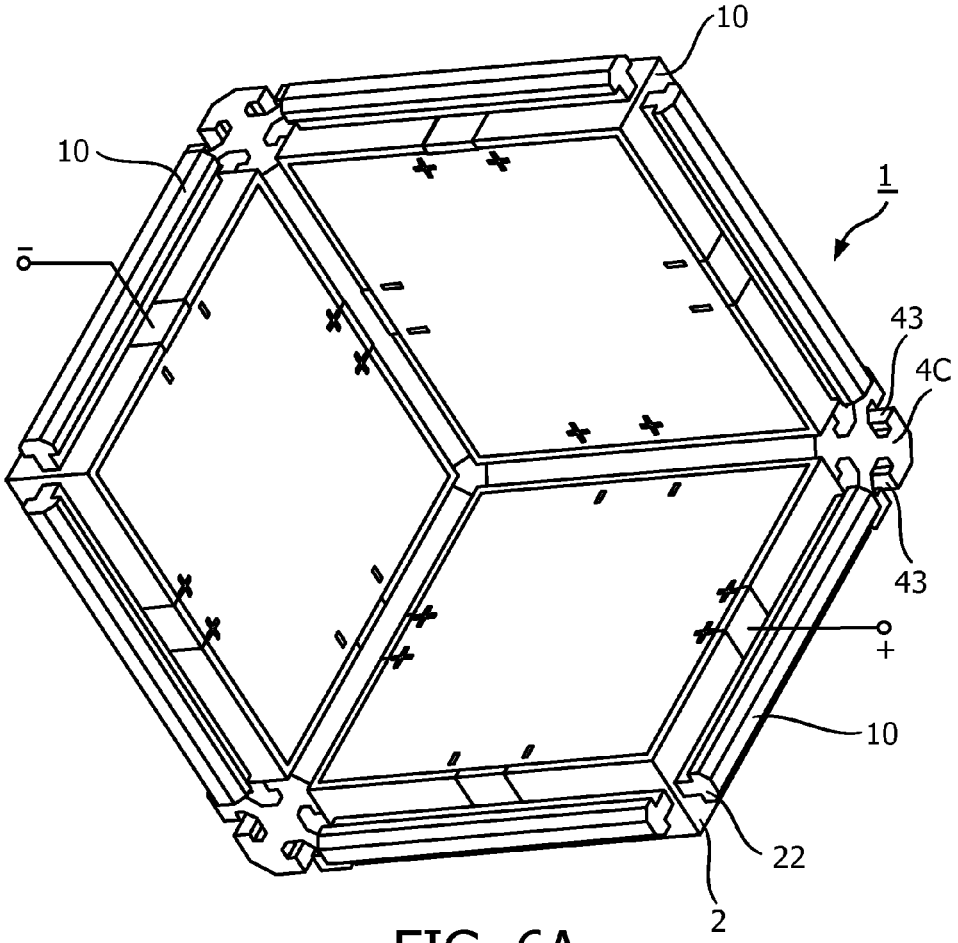
FIG. 6A shows a luminaire according to a second embodiment of the invention.
Figure 6B:
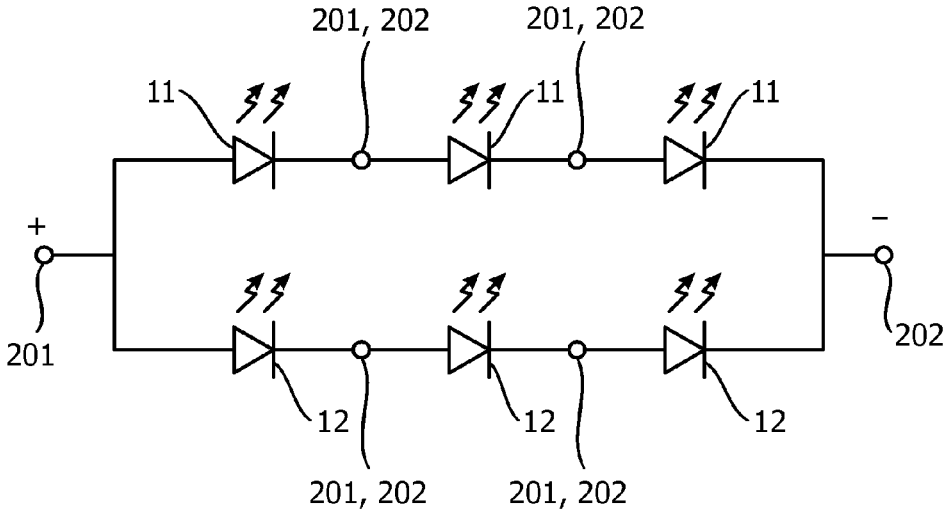
FIG. 6B shows an equivalent circuit of the luminaire of FIG. 6A.

FIG. 6A shows a luminaire 1 according to a second embodiment of the invention. Here, the luminaire elements 10 have only tongue connecting interfaces 22 on the housing frames 2, and three luminaire elements 10 are connected using additional assembly elements 4C to give a "three-dimensional" luminaire 1. The assembly elements 4C have grooves 43 to match the tongues 22 of the housing frames 2, arranged at right angles about the body of the assembly element 4C. Such a "three-dimensional" arrangement involves a combination of serial and parallel connections, as shown in the equivalent circuit of this luminaire in FIG. 6B. A series connection of three first OLEDs 11 (the upper three OLEDs) are connected in parallel with a series connection of three second OLEDs 12 (the lower three OLEDs). The upper OLED symbol connected to the "plus" pole of the power supply (indicated schematically here) corresponds to the first OLED device of the luminaire element in the bottom right of the diagram; the second OLED symbol corresponds to the first OLED device of the luminaire element in the upper right of the diagram; and the third OLED symbol connected to the "minus" pole of the power supply corresponds to the first OLED device of the luminaire element on the left of the diagram Again, the node symbols indicate the electrical connections between pairs of anode contact extending regions 201; pairs of cathode contact extending regions 202; or a connection between an anode contact extending region 201 and a cathode contact extending region 202, as appropriate.

Figure 7A:
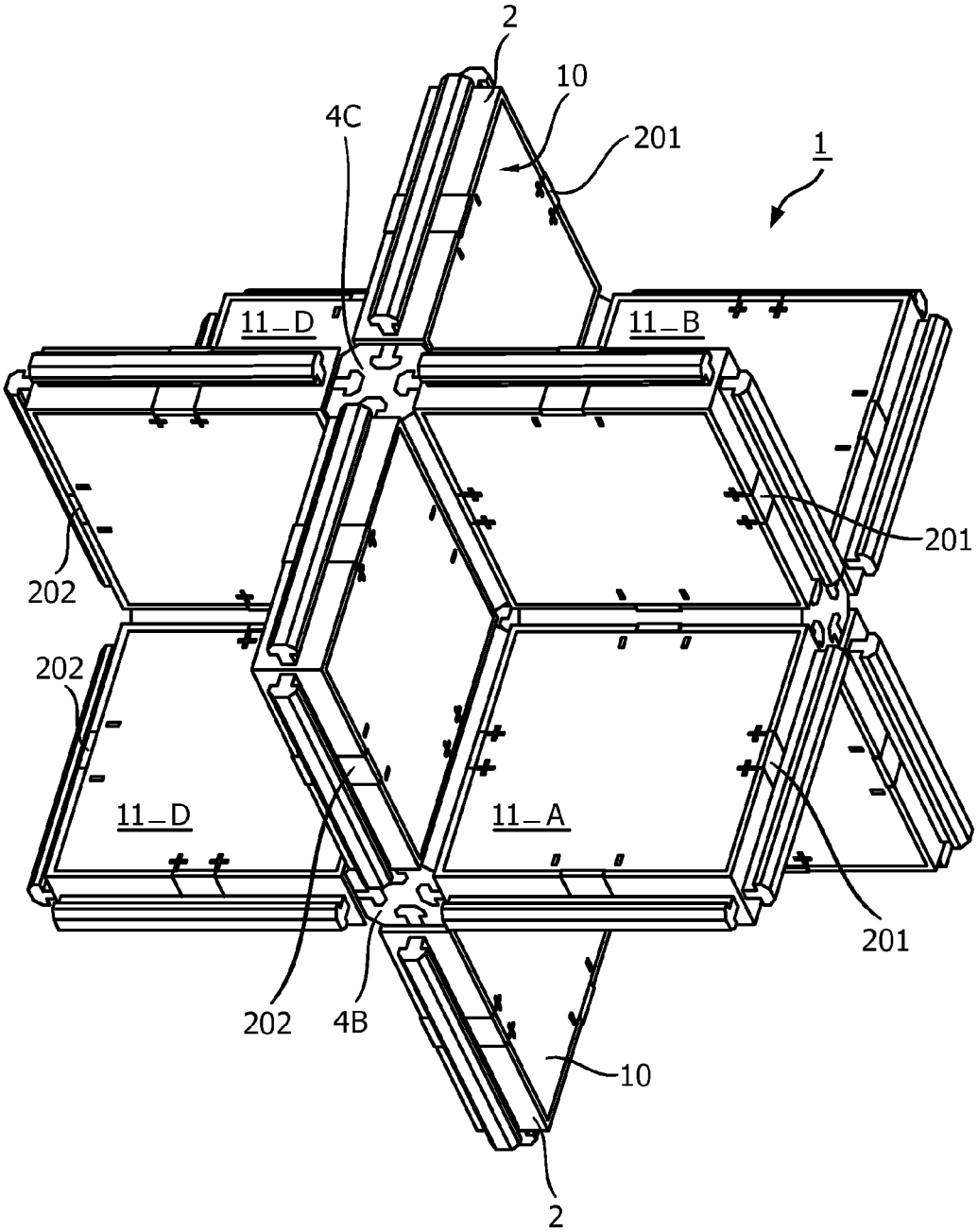
FIG. 7A shows a luminaire according to a third embodiment of the invention.
Figure 7B:
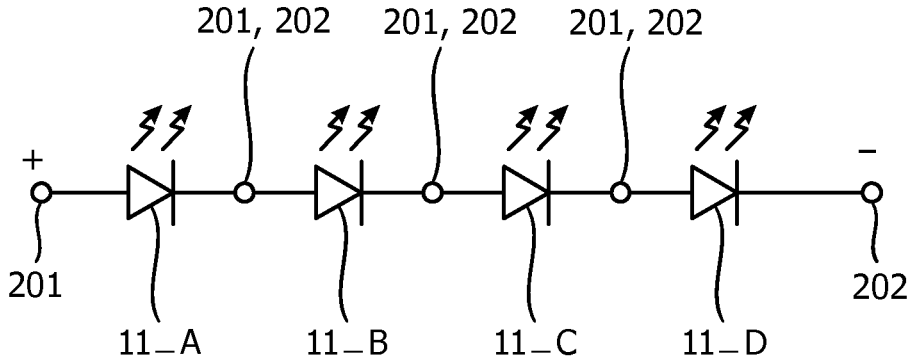
FIG. 7B shows an equivalent circuit of the luminaire of FIG. 7A.

FIG. 7A shows a luminaire 1 according to a third embodiment of the invention, showing that assembly elements 4B, 4C can be put to good effect in obtaining a luminaire that extends in various directions, while the luminaire elements 10 emit light from each of their front and back (or upper and lower) surfaces. Here, the luminaire 1 comprises six independent "planes", whereby a plane comprises either the first or the second OLEDs of a planar arrangement of luminaire elements. For example, one plane is given here by first OLEDs 11_A, 11_B, 11_C, 11_D. Again, the "plus" and "minus" poles of a power supply are indicated schematically for this plane. FIG. 7B shows the equivalent circuit for this plane only, using the same symbol notation as used in FIGS. 5B, 6B above. The equivalent circuits for the other five planes are similar.

Figure 8:
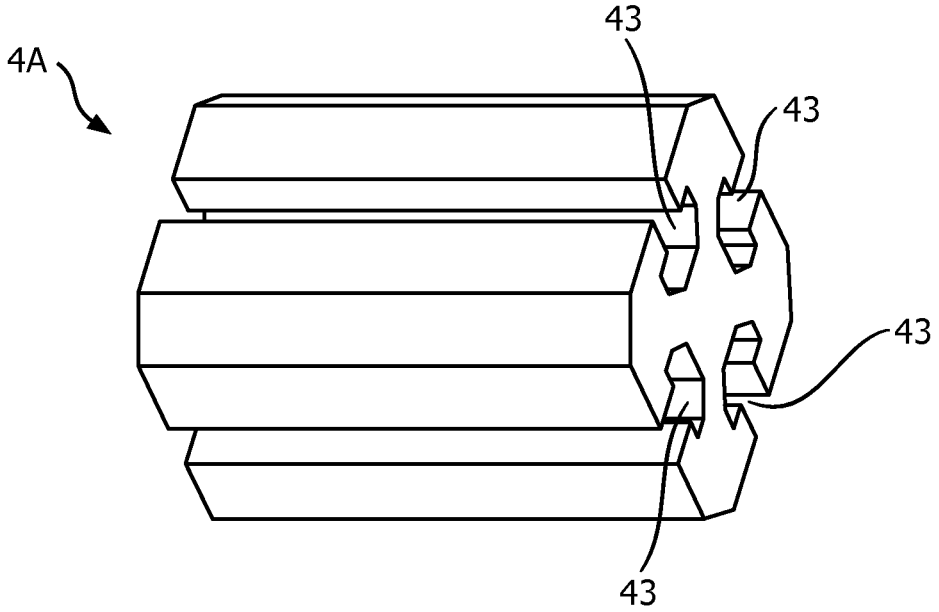
FIG. 8 shows a first embodiment of an assembly element for a luminaire according to the invention.
Figure 9:
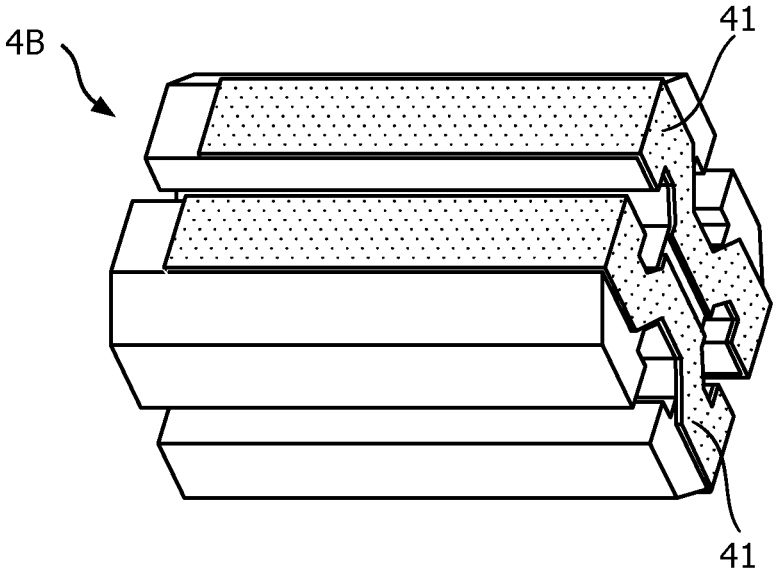
FIG. 9 shows a second embodiment of an assembly element for a luminaire according to the invention.
Figure 10:
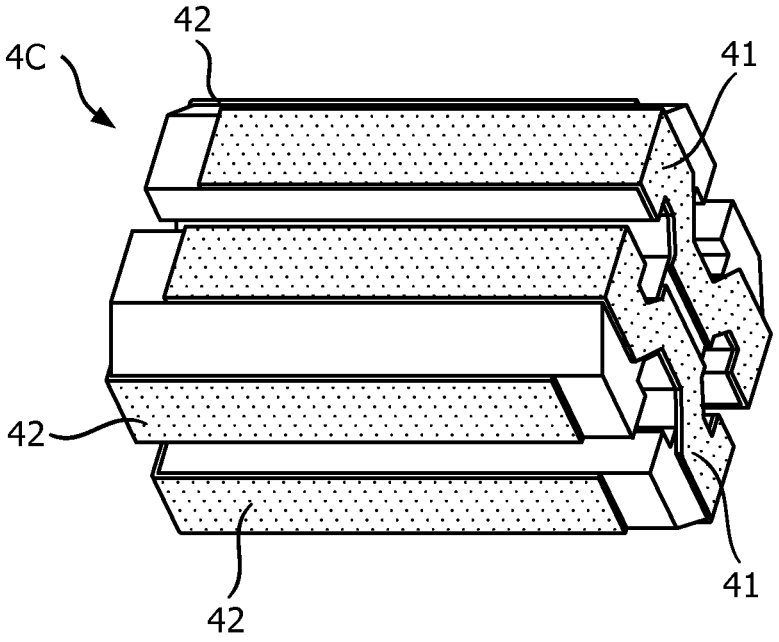
FIG. 10 shows a third embodiment of an assembly element for a luminaire according to the invention.

FIG. 8 shows a basic assembly element 4A, without any electrical connecting surfaces. This diagram shows the arrangement of four grooves 43 for "mating" with tongues of up to four luminaire elements. FIG. 9 shows an assembly element 4B, with connecting surfaces 41 arranged to connect the first OLED of a first luminaire element to the first OLED of a second luminaire element; and to connect the second OLED of the first luminaire element to the second OLED of the second luminaire element. FIG. 10 shows an assembly element 4C which makes the intersecting plane construction of FIG. 7A possible. Here, a first set of connecting surfaces 41 acts in the same way as those of FIG. 9. An additional set of connecting surfaces 42 is arranged to connect the first OLED of a third luminaire element to the first OLED of a fourth luminaire element; and to connect the second OLED of the third luminaire element to the second OLED of the fourth luminaire element.

Of course, for luminaire elements that are intended for an outer edge of a luminaire, housing frames can be provided that have connecting interfaces on only two sides, for example. The other two sides can be flat. In this way, a favourable optical result can be obtained. Alternatively, cover pieces can be provided that fit over the unused connecting interfaces in order to give the luminaire a "finished" appearance if so desired.

Although the present invention has been disclosed in the form of preferred embodiments and variations thereon, it will be understood that numerous additional modifications and variations could be made thereto without departing from the scope of the invention. The housing frames might be made large enough to enclose an array of standard OLEDs, for example a 2×2 array of first OLEDs above a 2×2 array of second OLEDs, and the frame flange can have a corresponding shape to hold the individual OLEDs. In this way, a luminaire with relatively large planar portions can be obtained with less frame connections.

For the sake of clarity, it is to be understood that the use of "a" or "an" throughout this application does not exclude a plurality, and "comprising" does not exclude other steps or elements.

The invention claimed is:

1. A luminaire element for a luminaire, which luminaire element comprises:

a first light-emitting device;

a second light-emitting device; and a frame configured to accommodate the first light-emitting device and the second light-emitting device, wherein the frame comprises at least one flange portion configured to extend outwardly from the frame, the flange portion comprising a connecting interface configured to physically and electrically connect to a further luminaire element of the luminaire, wherein the connecting interface comprises a tongue connector, and wherein the flange comprises first and second vertical extending regions each extending at a right angle with respect to the tongue connector of the flange, the first and second vertical extending regions preventing electrical contact other than at an electrode contact extending region;

Wherein the first light-emitting device and the second light-emitting device are arranged within the frame such that the first light-emitting device emits to a first side of the luminaire element and the second light-emitting device emits to a second side of the luminaire element;

wherein the luminaire element further comprises a layer element with a first electrically conductive contact joining region for joining spatially separate electrode contact regions of a first polarity and a second electrically conductive contact joining region for joining electrode contact regions of a second polarity;

Wherein the first contact joining region is electrically isolated from the second contact joining region, wherein the layer element is realized to be entirely accommodated between the light-emitting device and the flange portion of the frame.

2. A luminaire element according to claim 1, wherein the light-emitting device comprises an organic light-emitting device.

3. A luminaire element according to claim 1, wherein the first light-emitting device and the second light-emitting device are arranged in a back-to-back arrangement in the frame.

4. A luminaire element according to claim 3, wherein the light-emitting device comprises at least one anode contact region and at least one cathode contact region, wherein a contact region is arranged along an edge of the light-emitting device.

5. A luminaire element according to claim 1, wherein at least a portion of the flange portion is configured to extend into a cavity between the first light-emitting device and the second light-emitting device.

6. A luminaire comprising a plurality of luminaire elements according to claim 1, and wherein the luminaire elements are physically and electrically connected by connecting interfaces of the frames, and wherein electrode contacts of the light-emitting devices contained in the frames are electrically connected by electrode contact extending regions of the frames.

7. A luminaire according to claim 6, comprising an assembly element with a plurality of connecting interfaces, wherein a connecting interface of the assembly element is configured for connection to the connecting interface of the frame of the luminaire element.

8. An assembly element comprising a number of connecting interfaces, wherein a connecting interface of the assembly element is configured for connection to connecting interface of the frame of luminaire element according to claim 1.

9. An assembly element according to claim 8, comprising at least one electrode conductive region which electrode conductive region is arranged to electrically connect electrode contact extending regions of the frames of adjacent light-emitting luminaire elements physically connected by the assembly element.

10. A luminaire kit comprising a plurality of luminaire elements according to claim 1, and wherein the luminaire elements are physically and electrically connectable by connecting interfaces of the frames, and wherein electrode contacts of the light-emitting devices contained in the frames are electrically connected by electrode contact extending regions of the frames; and optionally a number of assembly elements for connecting luminaire elements.

* * * * *